US007980918B1

(12) United States Patent
Prilutsky

(10) Patent No.: US 7,980,918 B1
(45) Date of Patent: Jul. 19, 2011

(54) PLAYHOUSE

(75) Inventor: Zhanna Prilutsky, Mayfield Heights, OH (US)

(73) Assignee: The Step2 Company, LLC, Streetsboro, OH (US)

( * ) Notice: Subject to any disclaimer, the term of this patent is extended or adjusted under 35 U.S.C. 154(b) by 119 days.

(21) Appl. No.: 12/433,405

(22) Filed: Apr. 30, 2009

(51) Int. Cl.
*A63H 3/52* (2006.01)
*A63H 33/06* (2006.01)

(52) U.S. Cl. ..... 446/476; 446/478; 446/479; 446/120

(58) Field of Classification Search ..... 446/476, 446/478–479, 481–482, 85, 108, 120, 121, 446/124–128; 256/25, 26
See application file for complete search history.

(56) References Cited

U.S. PATENT DOCUMENTS 1,521,420 A * 12/1924 Beebe ..... 446/476
1,599,513 A * 9/1926 Caruso ..... 446/476
D87,610 S * 8/1932 Weiss ..... D21/511
D326,689 S 6/1992 Farinelli, Jr.
D346,836 S 5/1994 El-Masri et al.
D347,035 S 5/1994 El-Masri et al.
D351,637 S 10/1994 Neidig
D377,813 S 2/1997 Hartman et al.
5,890,338 A * 4/1999 Rodriguez-Ferre ..... 52/582.1
D409,261 S 5/1999 Kelley
6,728,981 B1 * 5/2004 Gutierrez ..... 5/414
D501,232 S 1/2005 Kirk
D508,095 S 8/2005 Greene
7,094,126 B1 * 8/2006 Lenihan ..... 446/481

OTHER PUBLICATIONS

Naturally Playful (Registered Trademark) Lookout Treehouse, The Step2 Company, LLC, Photograph (1 page), In public domain prior to Apr. 30, 2008.

* cited by examiner

*Primary Examiner* — Kien T Nguyen
(74) *Attorney, Agent, or Firm* — Ulmer & Berne LLP

(57) ABSTRACT

A playhouse is provided that includes an outer structure and a roof supported by and positioned atop the outer structure. The outer structure and the roof cooperate to at least partially define a first playspace. In one embodiment, the playhouse can further include a fence that at least partially defines a second playspace. The first and second playspaces can communicate with one another such that a person can travel between the first and second playspaces.

16 Claims, 4 Drawing Sheets

PLAYHOUSE

TECHNICAL FIELD

The invention relates generally to a toy and more particularly, to a playhouse.

BACKGROUND

Playhouses having a wide variety of designs are known, with the playhouses being configured to permit a child, or children to play within the playhouse.

SUMMARY

According to one embodiment, a playhouse is provided that includes an outer structure, a roof supported by and positioned atop the outer structure, and a fence having a first end and a second end. The fence extends continuously between the first end and the second end. The outer structure and the roof cooperate to at least partially define each of a first playspace and an end opening. Each of the first end and the second end of the fence is secured to the outer structure. The fence at least partially defines a second playspace. The second playspace communicates with the first playspace via the end opening such that a person can travel between the first playspace and the second playspace.

According to another embodiment, a playhouse is provided that includes an outer structure, a roof supported by and positioned atop the outer structure, and a shelf. The outer structure and the roof cooperate to at least partially define each of a first playspace and an end opening. The end opening is configured to permit a person to enter and exit the first playspace. The shelf includes a mount portion and an accessory tray integral with the mount portion. The mount portion is supported by the outer structure and the accessory tray extends into the first playspace.

According to another embodiment, a playhouse is provided that includes an outer structure and a roof supported by and positioned atop the roof. The outer structure and the roof cooperate to at least partially define each of a first playspace and an end opening. The end opening is configured to permit a person to enter and exit the first playspace. The playhouse further includes a periscope that has a lower portion positioned within the first playspace and an upper portion positioned above the roof. The playhouse further includes a shelf and a window box. The shelf includes a mount portion supported by the outer structure and an accessory tray integral with the mount portion. The accessory tray extends into the first playspace. The window box defines an open chamber and is integral with the shelf and positioned outside of the outer structure.

BRIEF DESCRIPTION OF THE DRAWINGS

Various embodiments according to the inventive principles will become better understood with regard to the following description, appended claims and accompanying drawings wherein:

DETAILED DESCRIPTION

Figure 1:
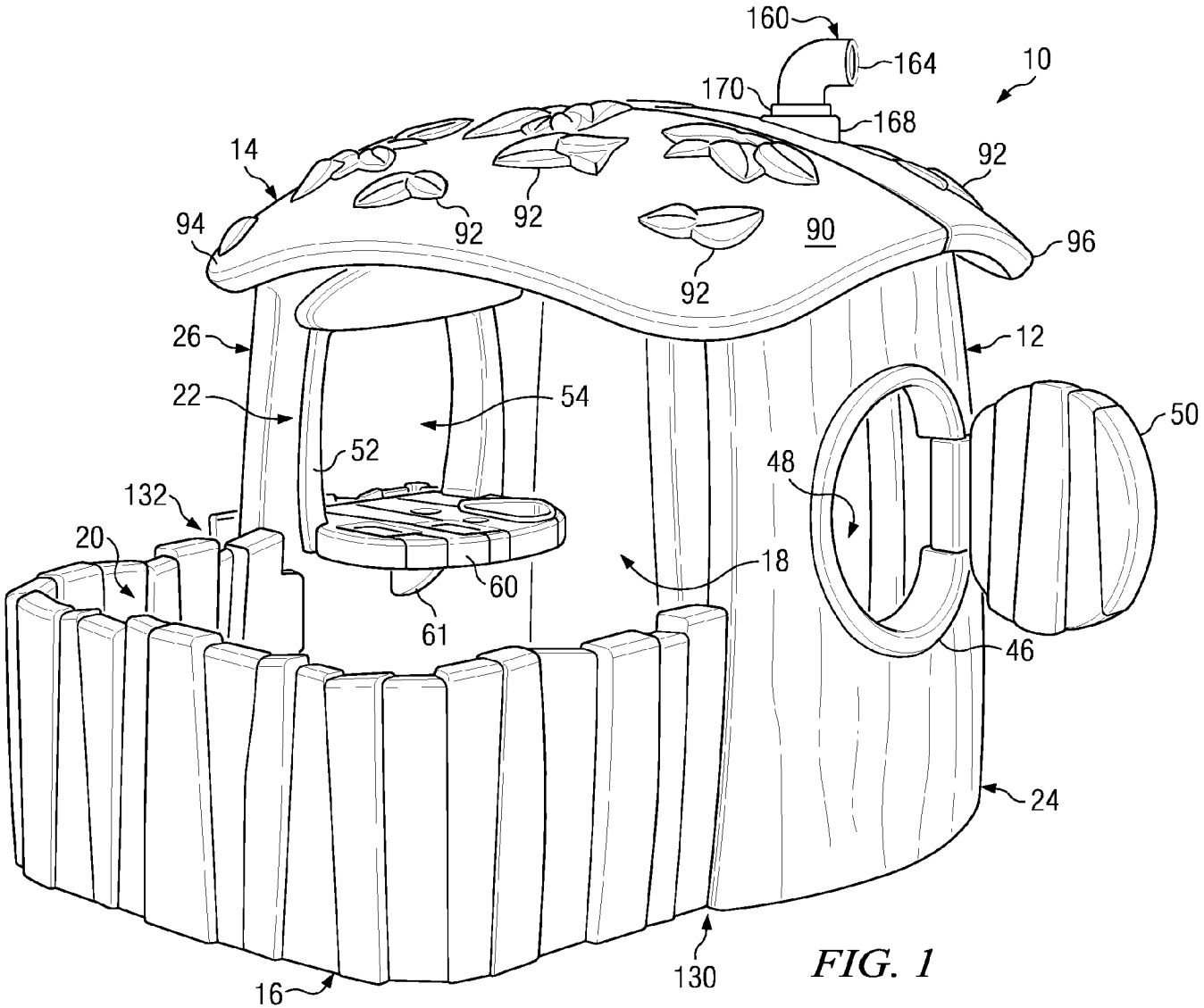
FIG. 1 is a front perspective view of a playhouse according to one embodiment.

FIGS. 1-4 illustrate a playhouse 10 according to one embodiment. As used herein, the terms "front", "rear", "forward" and/or "forwardly", and "rearward" and/or "rearwardly", are provided for purposes of orientation and reference to facilitate the description of the illustrated embodiment, and are not intended to be limiting. The playhouse 10 can include an outer structure 12 and a roof 14 that can be supported by and positioned atop the outer structure 12. The playhouse 10 can also include a fence 16 that can be secured to the outer structure 12. The outer structure 12 and the roof 14 can cooperate to at least partially define a first playspace 18. It will be appreciated that the first playspace 18 can also be partially defined by the surface upon which the playhouse 10 rests. In another embodiment, a playhouse can be provided that further includes a floor, with an outer structure, a roof and the floor cooperating to define a playspace.

The fence 16 at least partially defines a second playspace 20. It will be appreciated that the surface upon which playhouse 10 rests can also partially define the second playspace 20. The outer structure 12 and the roof 14 can also cooperate to define an end opening 22. The second playspace 20 can communicate with the first playspace 18 via the end opening 22, which permits a person, for example a child, to travel between the first playspace 18 and the second playspace 20. In other embodiments, a playhouse can be provided that can include an outer structure and a roof that cooperate to at least partially define a first playspace, and a fence that at least partially defines a second playspace, with the second playspace communicating with the first playspace via one or more doorways defined by one or more walls of the outer structure.

Figure 4:
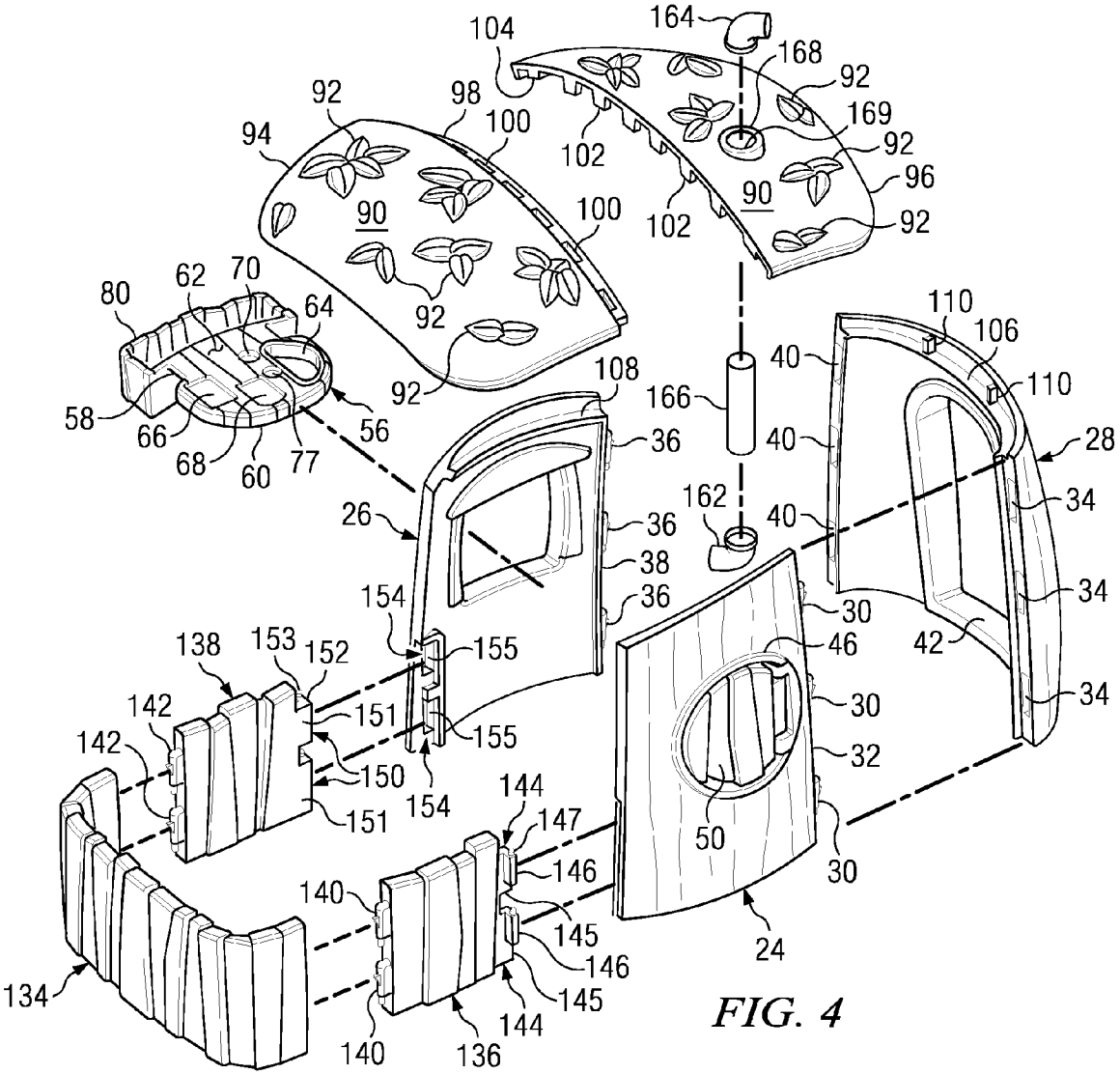
FIG. 4 is an exploded perspective view of the playhouse shown in FIGS. 1 and 2.

The outer structure 12 can include a plurality of interconnected walls. For example, the outer structure 12 can include a first side wall 24, a second side wall 26 and a rear wall 28. The rear wall 28 can extend between the first sidewall 24 and the second side wall 26, and can be secured to each of the first side wall 24 and the second side wall 26. As shown in FIG. 4, the first side wall 24 can include a first plurality of vertically spaced protrusions 30 that can extend rearwardly from a rear edge 32 of the first side wall 24. The rear wall 28 of the outer structure 12 can define a first plurality of vertically spaced slots 34. Each of the slots 34 can be aligned with, and can be configured to receive, a respective one of the protrusions 30. A lower end of each protrusion 30 can be shaped as a pin and can engage a respective aperture (not shown) defined by the rear wall 28, which can be achieved by moving the first side wall 24 downward relative to the rear wall 28 after the protrusion 30 is received within a respective one of the vertically spaced slots 34. Similarly, as shown in FIG. 4, the second side wall 26 can include a second plurality of vertically spaced protrusions 36 that can extend rearwardly from a rear edge 38 of the second side wall 26. The rear wall 28 of the outer structure 12 can define a second plurality of vertically spaced slots 40. Each of the slots 40 can be aligned with, and can be configured to receive, a respective one of the protrusions 36. A lower end of each of the protrusions 36 can be shaped as a pin and can be received within an aperture (not shown) defined by the rear wall 28, which can be achieved by moving the second side wall 26 downward relative to the rear wall 28, after the protrusion 36 is received within the respective slot 40. In another embodiment (not shown), a rear wall can be provided with a plurality of vertically spaced protrusions extending from each opposite side, with each of the protrusions engaging a respective one of a plurality of apertures that can be defined by each one of opposing side walls of a playhouse.

The rear wall 28 can include a door frame 42 that can define a doorway 44. The doorway 44 communicates with the first playspace 18 and is configured to permit a person, for example a child, to enter and exit the first playspace 18. The first side wall 24 can include a first window frame 46 that can define a first window 48. Playhouse 10 can further include a shutter 50 that can be pivotably connected to the first side wall 24. The shutter 50 can be pivotable between a closed position shown in FIG. 4 and an open position shown in FIG. 1, such that the shutter 50 is operable for closing and opening the window 48. Outer structure 12, roof 14, fence 16 and shutter 50 can be made from any suitable material, for example a plastic material, and can be made in any suitable manner, for example using a molding process. In one embodiment, outer structure 12, roof 14, fence 16 and shutter 50 can be formed form a plastic material using a rotomolding process, or any other suitable molding process.

Figure 2:
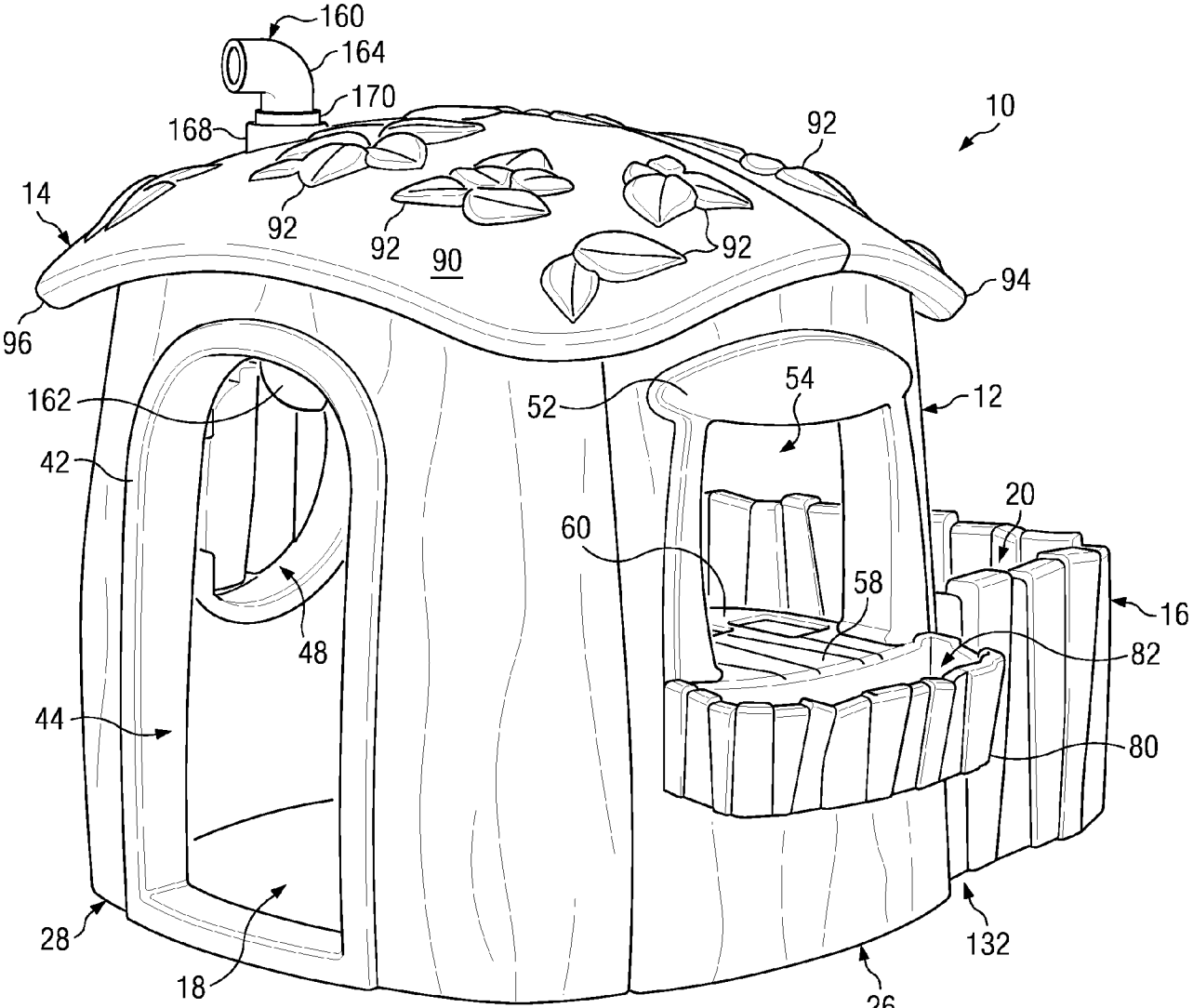
FIG. 2 is a rear perspective view of the playhouse shown in FIG. 1.
Figure 3:
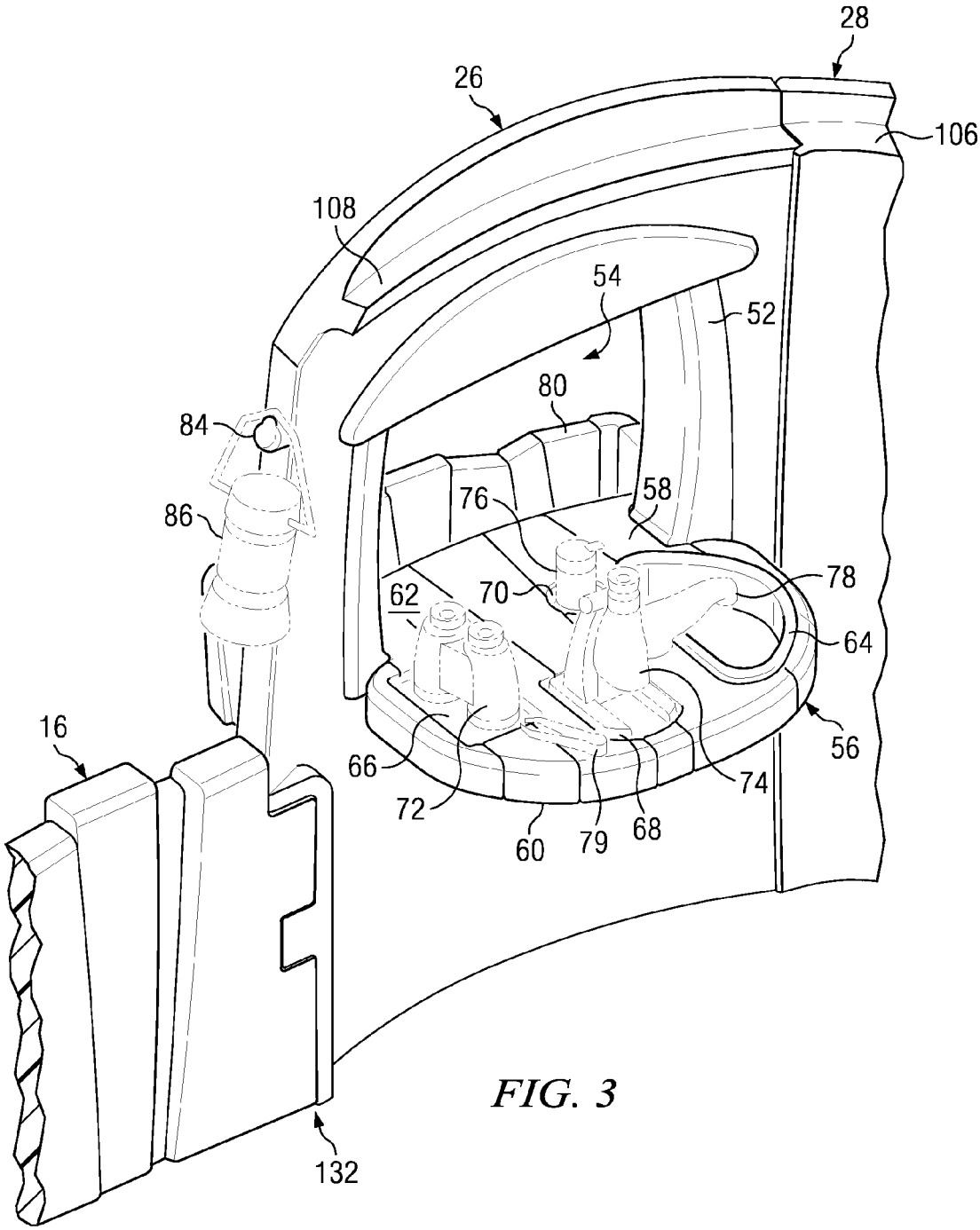
FIG. 3 is a perspective view of a portion of the playhouse shown in FIGS. 1 and 2.

The second side wall 26 can include a second window frame 52 that can define a second window 54 that communicates with the first playspace 18. Playhouse 10 can also include a shelf 56. As shown in FIG. 4, the shelf 56 can include a mount portion 58 and an accessory tray 60 that can be integral with the mount portion 58. The mount portion 58 can be supported by the outer structure 12. For example, the mount portion 58 of shelf 56 can be supported by the second window frame 54 of the second side wall 26 of the outer structure 12 as shown in FIGS. 1-3. Playhouse 10 can also include a bracket 61 (FIG. 1) that can provide further support for shelf 58. For example, bracket 61 can be secured to the second side wall 26 and can support tray 60. Mount portion 58 and tray 60 can be generally horizontally disposed, which facilitates supporting play items and/or other objects.

The shelf 56 can include an upper surface 62 (FIGS. 2-4) and a basin 64 that can be supported by, and extend below, the upper surface 62. The upper surface 62 of shelf 56 can define one or more depressions, which can have various sizes and shapes, with each of the depressions being configured to receive one or more play items such as one or more toys. For example, the upper surface 62 of shelf 56 can define depressions 66, 68, 70 and 77 (FIG. 4) that can support various play items. As shown in FIG. 3, a pair of binoculars 72 and a microscope 74 can be positioned within depressions 66 and 68, respectively, on the accessory tray 60 within the first playspace 18. A canister 76 can be positioned within the depression 70. A simulated water faucet 78 can be positioned within the depression 77 on the accessory tray 60 such that a spout of the faucet 78 is positioned over the basin 64. The shelf 56 can support other items that can be accessible to a child or children within playspace 18, including those that can be located on the upper surface 62 of shelf 56 but are not positioned within a depression. For example, other items that can enhance the enjoyment of playing outdoors, such as a butterfly net (not shown) and a pair of tongs 79 that can be used to handle butterflies or other insects, can be positioned on the upper surface 62 of shelf 56. The outer structure 12 of playhouse 10, for example the second side wall 26, can include a peg 84 that can be used to support various items such as a lantern 86.

The playhouse 10 can further include a window box 80. The window box 80 can include a pair of opposing sides, a pair of opposing ends, a bottom (not shown) and an open top, such that the window box 80 defines an open chamber 82. The open chamber 82 can be suitable for containing various items, for example real or artificial flowers or plants, or various play items. The window box 80 can be integral with the mount portion 58 of shelf 56 and can be positioned outside of the outer structure 12 of playhouse 10. Shelf 56 and window box 80 can be integrally formed from any suitable material, for example a plastic material, as a unitary structure. Shelf 56 and window box 80 can be formed using any suitable molding process, for example a rotomolding process.

Roof 14 can include an upper surface 90 and a plurality of decorative protrusions 92 extending above the upper surface 90. As will be appreciated with reference to FIGS. 1, 2, and 4, one or more of the decorative protrusions 92 can be shaped as a leaf. One or more of the decorative protrusions 92 can be shaped as a flower or other natural vegetation. Roof 14 can include one or more portions or sections. For example, as shown in FIG. 4, roof 14 can include a front portion 94 and a rear portion 96. Front portion 94 and rear portion 96 can be secured to one another and can be supported by the outer structure 12. Alternatively, a roof can be provided that is a unitary structure. The front portion 94 of roof 14 can include a rearwardly extending tongue 98 (FIG. 4) that can define a plurality of laterally spaced apertures 100. The rear portion 96 of roof 14 can include a plurality of laterally spaced and downwardly extending tabs 102. Each of the tabs 102 can be aligned with and inserted into a respective one of the apertures 100, which can secure the rear portion 96 of roof 14 to the forward portion 94 of roof 14.

The rear portion 96 of roof 14 can further include a rib 104 that extends below a lower surface of the rear portion 96. The rib 104 can extend partially or completely around a perimeter of the rear portion 96. The rib 104 can engage an upper ledge 106 of rear wall 28, and can also engage at least a portion of an upper ledge 108 of second side wall 26 and at least a portion of a similar upper ledge (not shown) of first side wall 24, such that the outer structure 12 supports roof 14. It will be appreciated that roofs and/or outer structures having other configurations can be provided to achieve a desired roof support. Rear wall 28 of outer structure 12 can include one or more upwardly extending pins 110. Each of the pins 110 can extend into a mating structure (not shown) defined by, or extending from, the lower surface of the rear portion 96 of roof 14, which facilitates positioning the roof 14 with respect to the outer structure 12. It can be appreciated with respect to FIGS. 1 and 2, that at least a portion of the roof 14 can overhang the outer structure 12.

As shown in FIG. 1, fence 16 can include a first end 130 and a second end 132. Each of the first and second ends 130, 132 can be secured to the structure 12 of playhouse 10. Fence 16 can be made as a unitary structure or, alternatively, fence 16 can include a plurality of interconnected sections. For example, as shown in FIG. 4, fence 16 can include a front section 134, a first side section 136 and a second side section 138. The first side section 136 can be interlocked with the front section 134, and with the first side wall 24 of the outer structure 12 at the first end 130 of fence 16. The second side section 138 can be interlocked with the front section 134, and with the second side wall 26 of the outer structure 12 at the second end 132 of fence 16. In other embodiments, a fence can be provided that includes a different number of interconnected sections than fence 16, and/or that can include one or more sections having a different configuration than the sections of fence 16 shown in FIG. 4. Fence 16 can extend continuously between the first end 130 and the second end 132. In other embodiments, a playhouse can be provided that includes a fence that is secured, at opposite ends, to an outer structure of the playhouse and that includes one or more gates, which can be opened, intermediate the opposite ends of the fence.

A forward end of the first side section 136 of fence 16 can include one or more tabs 140 and a forward end of the second side section 138 of fence 16 can include one or more tabs 142, as shown in FIG. 4. The front section 134 of fence 16 can include one or more slots (not shown) formed in each end. Each of the tabs 140 and each of the tabs 142 can engage a respective one of the slots defined by the front section 134 of fence 16.

A lower end of each tab 140 can be shaped as a pin and can engage a respective aperture (not shown) defined by the front section 134 of fence 16, which can be achieved by moving the first side section 136 of fence 16 downward relative to the front section 134 after each of the tabs 140 is received within the respective slot defined by the front section 134. Similarly, a lower end of each tab 142 can be shaped as a pin and can engage a respective aperture (not shown) defined by the front section 134. The second side section 138 and the front section 134 can be assembled in the same manner as the first side section 136 and the front section 134.

A rear end of the first side section 136 of fence 16 can include a plurality of vertically spaced protrusions 144, as shown in FIG. 4. Each of the protrusions 144 can include a rearwardly extending portion 145, an outwardly extending portion 146 and a pin 147 extending upwardly from the outwardly extending portion 146. The rearwardly extending portion 145 of each protrusion 144 can be received in a respective forwardly facing notch (not shown) defined by the first side wall 24 of outer structure 12. Each outwardly extending portion 146 can be received in a respective recess (not shown) defined by the first side wall 24, and each pin 147 can engage a respective aperture (not shown) defined by the first side wall 24. After the rearwardly extending portion 145 and outwardly extending portion 146 of each protrusion 144 engage the respective forwardly facing notches and recesses in the first sidewall 24, respectively, the first side wall 24 can be moved downwardly relative to the first side section 136 of fence 16 so that each pin 147 engages the respective aperture in the first side wall 24, which can interlock the first side section 136 of fence 16 and the first side wall 24 of outer structure 12.

Similarly, a rear end of the second side section 138 of fence 16 can include one or more protrusions 150. Each of the protrusions 150 can include a rearwardly extending portion 151, an outwardly extending portion 152 and a pin 153 extending upwardly from the outwardly extending portion 152. Each rearwardly extending portion 151 can be received in a respective forwardly facing notch 154 defined by the second side wall 26 of the outer structure 12, and each of the outwardly extending portions 152 can be received in a respective recess 155 defined by the second side wall 26. Each pin 153 can be received in a respective aperture (not shown) defined by the second side wall 26. The second side section 138 of fence 16 and the second side wall 26 of outer structure 12 can be assembled in the same manner as the first side section 136 of fence 16 and the first side wall 24 of outer structure 12.

Playhouse 10 can also include a periscope 160 (FIG. 2). As shown in FIG. 4, the periscope 160 can include a lower portion 162, an upper portion 164 and an intermediate portion 166 that can be engaged with each of the lower portion 162 and the upper portion 164. In one embodiment, the intermediate portion 166 can extend into the lower portion 162 and the upper portion 164, and each of the portions 162, 164 and 166 can be sized such that the intermediate portion 166 engages each of the lower portion 162 and the upper portion 164 in a friction fit. The lower portion 162 of periscope 160 can be positioned within the first playspace 18 and can be oriented to facilitate looking into the periscope 160 for viewing the environment surrounding playhouse 10. The roof 14 can include a hollow embossment 168 extending upwardly from the upper surface 90 of roof 14. The embossment 168 can define an aperture 169 that is sized to receive the intermediate portion 166 of periscope 160. The intermediate portion 166 can extend through the embossment 168 such that the upper portion 164 is positioned above the roof 14. The upper portion 164 can be oriented to facilitate viewing the environment surrounding playhouse 10. The upper portion 164 of periscope 160 can include a lower flange 170 (FIGS. 1 and 2) that can be sized to abut the embossment 168, which can prevent the periscope 160 from moving downwardly.

The features and configuration of playhouse 10 can enhance a child's enjoyment of nature, when playhouse 10 is positioned outdoors. For example, a child positioned within the first playspace 18 can view the environment surrounding playhouse 10 by using the periscope 160, or by looking out of the first window 48, the second window 54, the end opening 22, or the doorway 44. Due to the end opening 22, a child can travel freely between the first playspace 18 and the second playspace 20. The position of the accessory tray 60 of shelf 56 within the first playspace 18 can give children located within playspace 18 ready access to a variety of play items, which can be used to further enjoy nature. For example, play items that can include the pair of binoculars 72, the microscope 74, the canister 76, the tongs 79 and others, such as a butterfly net (not shown), can be placed on accessory tray 60 and can be accessed by a child positioned within the first playspace 18. A vertical height of the fence 16 can be sized such that children of certain ages and height that are in the second playspace 20 can look over the fence 16 to view the environment surrounding playhouse 10, and can use the binoculars 72 in this regard if desired. Other examples of possible uses of play items located on the accessory tray 60 include the following. A child within playspace 20 may choose to use a butterfly net to catch a butterfly and a child within either playspace 18 or playspace 20 may choose to catch one or more other insects. The child may decide to place the insects in canister 76, and later remove the insects from canister 76 for examination using microscope 74. The child may choose to use the tongs 79 when handling the insects.

The decorative protrusions 92 can be compatible with a natural environment outside of playhouse 10. For example, one or more of the decorative protrusions can be shaped as a leaf, a flower or other natural vegetation. This compatibility of playhouse 10 with the natural environment can be further enhanced by placing real or artificial flowers, or other natural vegetation, within the open chamber 82 defined by the window box 80.

While the inventive principles have been illustrated by the description of various embodiments thereof, and while the embodiments have been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus, methods and examples shown and described. Accordingly, departures may be made from such details without departing from the scope or spirit of the general inventive principles.

What is claimed is:

1. A playhouse comprising:

an outer structure;

a roof supported by and positioned atop the outer structure; and a fence having a first end and a second end, the fence extending continuously between the first end and the second end; wherein the outer structure and the roof cooperate to at least partially define each of a first playspace and an end opening;

each of the first end and the second end of the fence is secured to the outer structure;

the fence at least partially defines a second playspace;

the second playspace communicates with the first playspace via the end opening such that a person can travel between the first playspace and the second playspace;

the outer structure comprises a first side wall, a second side wall and a rear wall extending between the first side wall and the second side wall, the rear wall being secured to each of the first side wall and the second side wall;

the first side wall comprises a first window frame defining a first window;

the playhouse further comprises a shutter pivotably connected to the first side wall, the shutter being operable for opening and closing the first window;

the second side wall comprises a second window frame defining a second window;

the playhouse further comprises a shelf, the shelf comprising a mount portion and an accessory tray integral with the mount portion; and the mount portion is supported by the second window frame and the accessory tray extends into the first playspace.

2. The playhouse of claim 1 wherein:

the rear wall comprises a door frame defining a doorway, the doorway communicating with the first playspace, the doorway being configured to permit a person to enter and exit the first playspace.

3. The playhouse of claim 1, further comprising:

a periscope comprising a lower portion, an upper portion, and an intermediate portion engaged with each of the lower portion and the upper portion; wherein the lower portion is positioned within the first playspace and configured to facilitate looking into the periscope;

the intermediate portion extends through the roof; and the upper portion is positioned above the roof.

4. The playhouse of claim 1, further comprising:

a window box defining an open chamber, the window box being integral with the shelf and positioned outside of the second side wall.

5. The playhouse of claim 4, wherein:

the shelf and the window box are integrally formed from a plastic material as a unitary structure.

6. The playhouse of claim 1, wherein:

the shelf comprises an upper surface defining at least one depression, the shelf further comprising a basin supported by and extending below the upper surface.

7. The playhouse of claim 1, wherein:

the roof comprises an upper surface and a plurality of decorative protrusions extending above the upper surface.

8. The playhouse of claim 7, wherein:

at least one of the decorative protrusions is shaped as a leaf.

9. The playhouse of claim 1, wherein:

the fence comprises a plurality of sections interlocked with one another;

a first one of the sections is interlocked with the first side wall of the outer structure at the first end of the fence; and a second one of the sections is interlocked with the second side wall of the outer structure at the second end of the fence.

10. The playhouse of claim 1, wherein:

the fence comprises a front section, a first side section and a second side section;

the first side section is interlocked with the front section and with the first side wall of the outer structure at the first end of the fence; and the second side section is interlocked with the front section and with the second side wall of the outer structure at the second end of the fence.

11. A playhouse comprising:

an outer structure;

a roof supported by and positioned atop the outer structure, the outer structure and the roof cooperating to at least partially define each of a first playspace and an end opening, the end opening being configured to permit a person to enter and exit the first playspace; and a shelf comprising a mount portion and an accessory tray integral with the mount portion, the mount portion being supported by the outer structure, the accessory tray extending into the first playspace; wherein the outer structure comprises a first window frame defining a first window, the mount portion of the shelf being supported by the first window frame; and the playhouse further comprises a window box defining an open chamber, the window box being integral with the mount portion of the shelf and positioned outside of the outer structure.

12. The playhouse of claim 11, wherein:

the shelf and the window box are integrally formed from a plastic material as a unitary structure.

13. The playhouse of claim 11, further comprising:

a fence having a first end and a second end, each of the first end and the second end being secured to the outer structure, the fence extending continuously between the first end and the second end; wherein the fence at least partially defines a second playspace; and the outer structure defines a doorway, each of the end opening and the doorway communicating with the first playspace and configured to permit a person to enter and exit the first playspace;

the second playspace communicates with the first playspace via one of the end opening and the doorway such that a person can travel between the first and second playspaces.

14. A playhouse comprising:

an outer structure;

a roof supported by and positioned atop the outer structure, the outer structure and the roof cooperating to at least partially define each of a first playspace and an end opening, the end opening being configured to permit a person to enter and exit the first playspace;

a periscope comprising a lower portion positioned within the first playspace and an upper portion positioned above the roof;

a shelf comprising a mount portion and an accessory tray integral with the mount portion, the mount portion being supported by the outer structure, the accessory tray extending into the first playspace; and a window box defining an open chamber, the window box being integral with the mount portion of the shelf and positioned outside of the outer structure.

15. The playhouse of claim 14, wherein:

the periscope further comprises an intermediate portion engaged with each of the lower portion and the upper portion;

the roof comprises a raised, hollow embossment communicating with the first playspace;

the intermediate portion of the periscope extends through the hollow embossment; and the upper portion of the periscope comprises an outer flange supported by the raised, hollow embossment.

16. The playhouse of claim 14, further comprising:

a fence comprising a first end and a second end, each of the first end and, the second end being secured to the outer structure, the fence extending continuously between the first end and the second end; wherein the fence at least partially defines a second playspace that communicates with the first playspace.

* * * * *

UNITED STATES PATENT AND TRADEMARK OFFICE

CERTIFICATE OF CORRECTION

PATENT NO. : 7,980,918 B1
APPLICATION NO. : 12/433405
DATED : July 19, 2011
INVENTOR(S) : Zhanna Prilutsky It is certified that error appears in the above-identified patent and that said Letters Patent is hereby corrected as shown below:

Claim 16, Column 9, line 7, change “and, the” to -- and the --.

Signed and Sealed this
Eighth Day of November, 2011

David J. Kappos

David J. Kappos
*Director of the United States Patent and Trademark Office*